US006678647B1

(12) United States Patent
Edler et al.

(10) Patent No.: US 6,678,647 B1
(45) Date of Patent: Jan. 13, 2004

(54) PERCEPTUAL CODING OF AUDIO SIGNALS USING CASCADED FILTERBANKS FOR PERFORMING IRRELEVANCY REDUCTION AND REDUNDANCY REDUCTION WITH DIFFERENT SPECTRAL/TEMPORAL RESOLUTION

(75) Inventors: Bernd Andreas Edler, Niedersachsen (DE); Christof Faller, Taegerwilen (CH)

(73) Assignee: Agere Systems Inc., Allentown, PA (US)

( * ) Notice: Subject to any disclaimer, the term of this patent is extended or adjusted under 35 U.S.C. 154(b) by 463 days.

(21) Appl. No.: 09/586,070

(22) Filed: Jun. 2, 2000

(51) Int. Cl.[7] ..... G10L 19/00; G10L 19/02

(52) U.S. Cl. ..... 704/200.1; 704/503; 704/203; 704/243; 704/206; 704/219; 704/229

(58) Field of Search ..... 704/200.1, 500–504, 704/203, 230, 219, 229, 222, 243, 201, 211, 206; 381/2

(56) References Cited

U.S. PATENT DOCUMENTS 5,285,498 A * 2/1994 Johnston ..... 381/2
5,481,614 A * 1/1996 Johnston ..... 381/2
5,627,938 A * 5/1997 Johnston ..... 704/200.1
5,727,119 A * 3/1998 Davidson et al. ..... 704/203
5,852,806 A * 12/1998 Johnston et al. ..... 704/500
5,913,190 A * 6/1999 Fielder et al. ..... 704/229
5,913,191 A * 6/1999 Fielder ..... 704/230
5,956,674 A * 9/1999 Smyth et al. ..... 704/200.1
5,974,380 A * 10/1999 Smyth et al. ..... 704/229
5,978,762 A * 11/1999 Smyth et al. ..... 704/229
6,104,996 A * 8/2000 Yin ..... 704/500
6,314,391 B1 * 11/2001 Tsutsui et al. ..... 704/214
6,484,142 B1 * 11/2002 Miyasaka et al. ..... 704/500

OTHER PUBLICATIONS

Srinivasan et al., ("High–Quality Audio Compression Using an Adaptive Wavelet Packet Decomposition and Psychoacoustic Modeling", IEEE Transactions on Signal Processing, vol. 46, No. 4, Apr. 1998, pp. 1085–1093).*
Johnston et al., ("Sum–Difference stereo transform coding", 1992 IEEE International Conference on Acoustics, Speech, and Signal Processing, ICASSP–92, vol. 2, pp. 569–572).*

* cited by examiner

*Primary Examiner*—Vijay Chawan
(74) *Attorney, Agent, or Firm*—Ryan, Mason & Lewis, LLP

(57) ABSTRACT

A perceptual audio coder is disclosed for encoding audio signals, such as speech or music, with different spectral and temporal resolutions for the redundancy reduction and irrelevancy reduction using cascaded filterbanks. The disclosed perceptual audio coder includes a first analysis filterbank for performing irrelevancy reduction in accordance with a psychoacoustic model and a second analysis filterbank for performing redundancy reduction. The spectral/temporal resolution of the first filterbank can be optimized for irrelevancy reduction and the spectral/temporal resolution of the second filterbank can be optimized for maximum redundancy reduction. The disclosed perceptual audio coder also includes a scaling block between the cascaded filterbank that scales the spectral coefficients, based on the employed perceptual model.

23 Claims, 4 Drawing Sheets

PERCEPTUAL CODING OF AUDIO SIGNALS USING CASCADED FILTERBANKS FOR PERFORMING IRRELEVANCY REDUCTION AND REDUNDANCY REDUCTION WITH DIFFERENT SPECTRAL/TEMPORAL RESOLUTION

CROSS-REFERENCE TO RELATED APPLICATIONS

The present invention is related to U.S. patent application Ser. No. 09/586,072, entitled "Perceptual Coding of Audio Signals Using Separated Irrelevancy Reduction and Redundancy Reduction, " U.S. patent application Ser. No. 09/586,071, entitled "Method and Apparatus for Representing Masked Thresholds in a Perceptual Audio Coder," U.S. patent application Ser. No. 09/586,069, entitled "Method and Apparatus for Reducing Aliasing in Cascaded Filter Banks," and U.S. patent application Ser. No. 09/586,068, entitled "Method and Apparatus for Detecting Noise-Like Signal Components," filed contemporaneously herewith, assigned to the assignee of the present invention and incorporated by reference herein.

FIELD OF THE INVENTION

The present invention relates generally to audio coding techniques, and more particularly, to perceptually-based coding of audio signals, such as speech and music signals.

BACKGROUND OF THE INVENTION

Perceptual audio coders (PAC) attempt to minimize the bit rate requirements for the storage or transmission (or both) of digital audio data by the application of sophisticated hearing models and signal processing techniques. Perceptual audio coders are described, for example, in D. Sinha et al., "The Perceptual Audio Coder," Digital Audio, Section 42, 42-1 to 42-18, (CRC Press, 1998), incorporated by reference herein. In the absence of channel errors, a PAC is able to achieve near stereo compact disk (CD) audio quality at a rate of approximately 128 kbps. At a lower rate of 96 kbps, the resulting quality is still fairly close to that of CD audio for many important types of audio material.

Perceptual audio coders reduce the amount of information needed to represent an audio signal by exploiting human perception and minimizing the perceived distortion for a given bit rate. Perceptual audio coders first apply a time-frequency transform, which provides a compact representation, followed by quantization of the spectral coefficients. FIG. 1 is a schematic block diagram of a conventional perceptual audio coder 100. As shown in FIG. 1, a typical perceptual audio coder 100 includes an analysis filterbank 110, a perceptual model 120, a quantization and coding block 130 and a bitstream encoder/multiplexer 140.

The analysis filterbank 110 converts the input samples into a sub-sampled spectral representation. The perceptual model 120 estimates the masked threshold of the signal. For each spectral coefficient, the masked threshold gives the maximum coding error that can be introduced into the audio signal while still maintaining perceptually transparent signal quality. The quantization and coding block 130 quantizes and codes the spectral values according to the precision corresponding to the masked threshold estimate. Thus, the quantization noise is hidden by the respective transmitted signal. Finally, the coded spectral values and additional side information are packed into a bitstream and transmitted to the decoder by the bitstream encoder/multiplexer 140.

FIG. 2 is a schematic block diagram of a conventional perceptual audio decoder 200. As shown in FIG. 2, the perceptual audio decoder 200 includes a bitstream decoder/demultiplexer 210, a decoding and inverse quantization block 220 and a synthesis filterbank 230. The bitstream decoder/demultiplexer 210 parses and decodes the bitstream yielding the coded spectral values and the side information. The decoding and inverse quantization block 220 performs the decoding and inverse quantization of the quantized spectral values. The synthesis filterbank 230 transforms the spectral values back into the time-domain.

Generally, the amount of information needed to represent an audio signal is reduced using two well-known techniques, namely, irrelevancy reduction and redundancy removal. Irrelevancy reduction techniques attempt to remove those portions of the audio signal that would be, when decoded, perceptually irrelevant to a listener. This general concept is described, for example, in U.S. Pat. No. 5,341,457, entitled "Perceptual Coding of Audio Signals," by J. L. Hall and J. D. Johnston, issued on Aug. 23, 1994, incorporated by reference herein.

Currently, most audio transform coding schemes implemented by the analysis filterbank 110 to convert the input samples into a sub-sampled spectral representation employ a single spectral decomposition for both irrelevancy reduction and redundancy reduction. The redundancy reduction is obtained by dynamically controlling the quantizers in the quantization and coding block 130 for the individual spectral components according to perceptual criteria contained in the psychoacoustic model 120. This results in a temporally and spectrally shaped quantization error after the inverse transform at the receiver 200. As shown in FIGS. 1 and 2, the psychoacoustic model 120 controls the quantizers 130 for the spectral components and the corresponding dequantizer 220 in the decoder 200. Thus, the dynamic quantizer control information needs to be transmitted by the perceptual audio coder 100 as part of the side information, in addition to the quantized spectral components.

The redundancy reduction is based on the decorrelating property of the transform. For audio signals with high temporal correlations, this property leads to a concentration of the signal energy in a relatively low number of spectral components, thereby reducing the amount of information to be transmitted. By applying appropriate coding techniques, such as adaptive Huffinan coding, this leads to a very efficient signal representation.

One problem encountered in audio transform coding schemes is the selection of the optimum transform length. The optimum transform length is directly related to the frequency resolution. For relatively stationary signals, a long transform with a high frequency resolution is desirable, thereby allowing for accurate shaping of the quantization error spectrum and providing a high redundancy reduction. For transients in the audio signal, however, a shorter transform has advantages due to its higher temporal resolution. This is mainly necessary to avoid temporal spreading of quantization errors that may lead to echoes in the decoded signal.

As shown in FIG. 1, however, conventional perceptual audio coders 100 typically use a single spectral decomposition for both irrelevancy reduction and redundancy reduction. Thus, the spectral/temporal resolution for the redundancy reduction and irrelevancy reduction must be the same. While high spectral resolution yields a high degree of redundancy reduction, the resulting long transform window size causes reverbation artifacts, impairing the irrelevancy reduction. A need therefore exists for methods and apparatus for encoding audio signals that permit independent selection of spectral and temporal resolutions for the redundancy reduction and irrelevancy reduction. A further need exists for methods and apparatus for encoding speech as well as music signals using a psychoacoustic model (a noise-shaping filter) and a transform.

SUMMARY OF THE INVENTION

Generally, a perceptual audio coder is disclosed for encoding audio signals, such as speech or music, with different spectral and temporal resolutions for the redundancy reduction and irrelevancy reduction using cascaded filterbanks. The disclosed perceptual audio coder includes a first analysis filterbank for performing irrelevancy reduction in accordance with a psychoacoustic model and a second analysis filterbank for performing redundancy reduction. In this manner, the spectral/temporal resolution of the first filterbank can be optimized for irrelevancy reduction and the spectral/temporal resolution of the second filterbank can be optimized for maximum redundancy reduction.

The disclosed perceptual audio coder also includes a scaling block between the cascaded filterbank that scales the spectral coefficients, based on the employed perceptual model. The first analysis filterbank converts the input samples into a sub-sampled spectral representation to perform irrelevancy reduction. The second analysis filterbank performs redundancy reduction using a subband technique. A quantization and coding block quantizes and codes the spectral values according to the precision specified by the masked threshold estimate received from the perceptual model. The second analysis filterbank is optionally adaptive to the statistics of the signal at the input to the second filterbank to determine the best spectral and temporal resolution for performing the redundancy reduction.

A more complete understanding of the present invention, as well as further features and advantages of the present invention, will be obtained by reference to the following detailed description and drawings.

DETAILED DESCRIPTION

Figure 1:
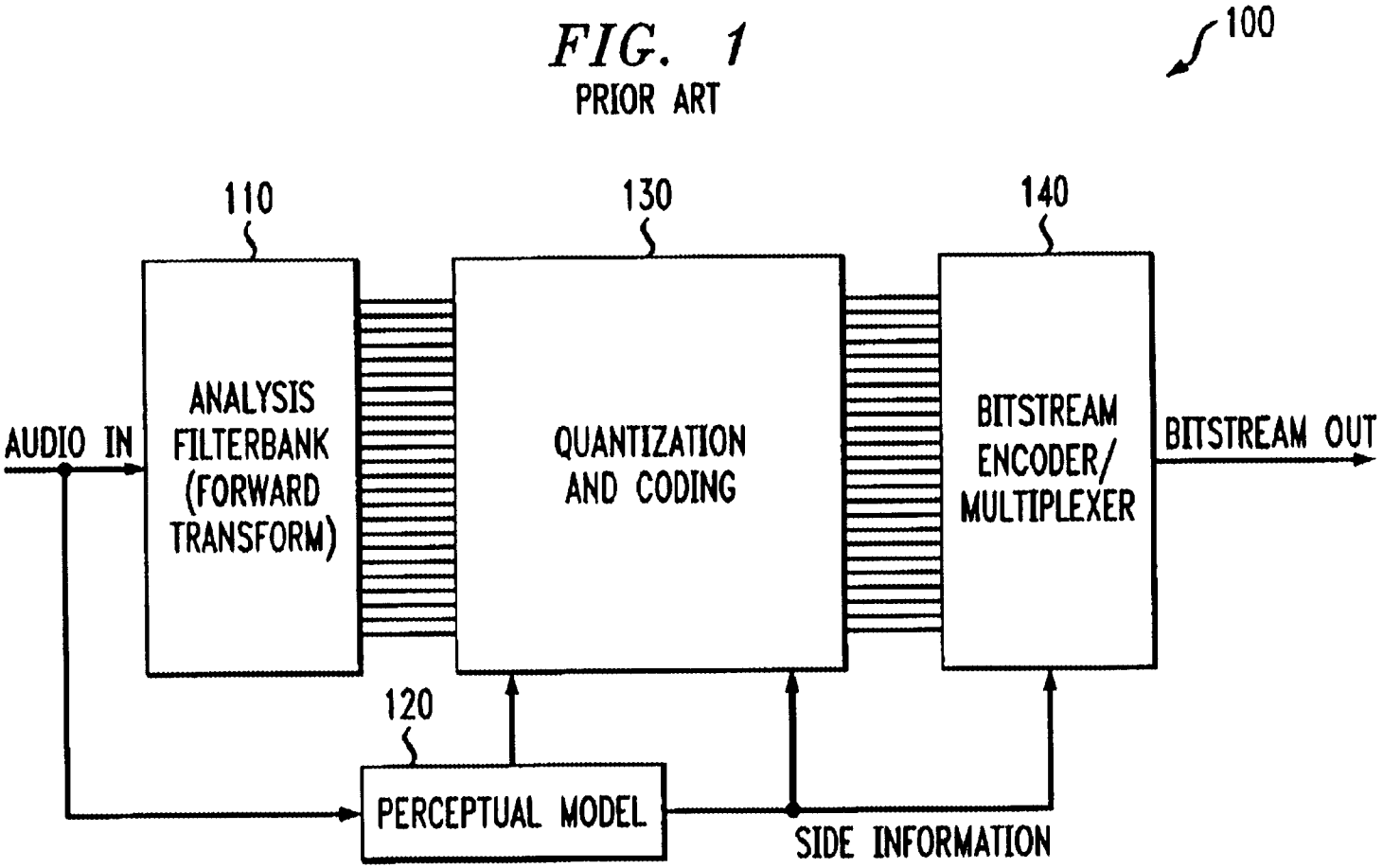
FIG. 1 PRIOR ART
FIG. 1 is a schematic block diagram of a conventional perceptual audio coder.
Figure 2:
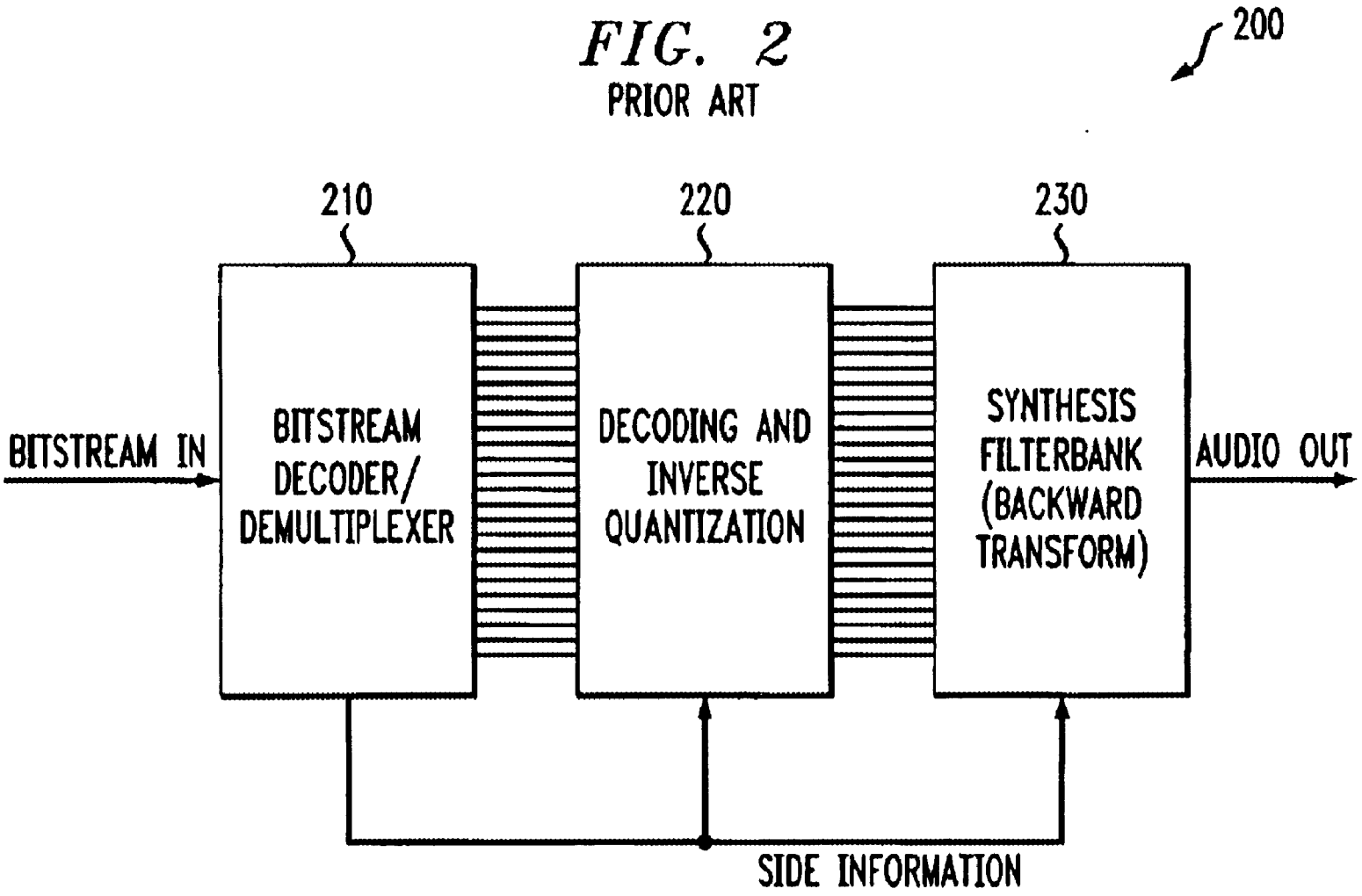
FIG. 2 PRIOR ART
FIG. 2 is a schematic block diagram of a conventional perceptual audio decoder corresponding to the perceptual audio coder of FIG. 1.
Figure 3:
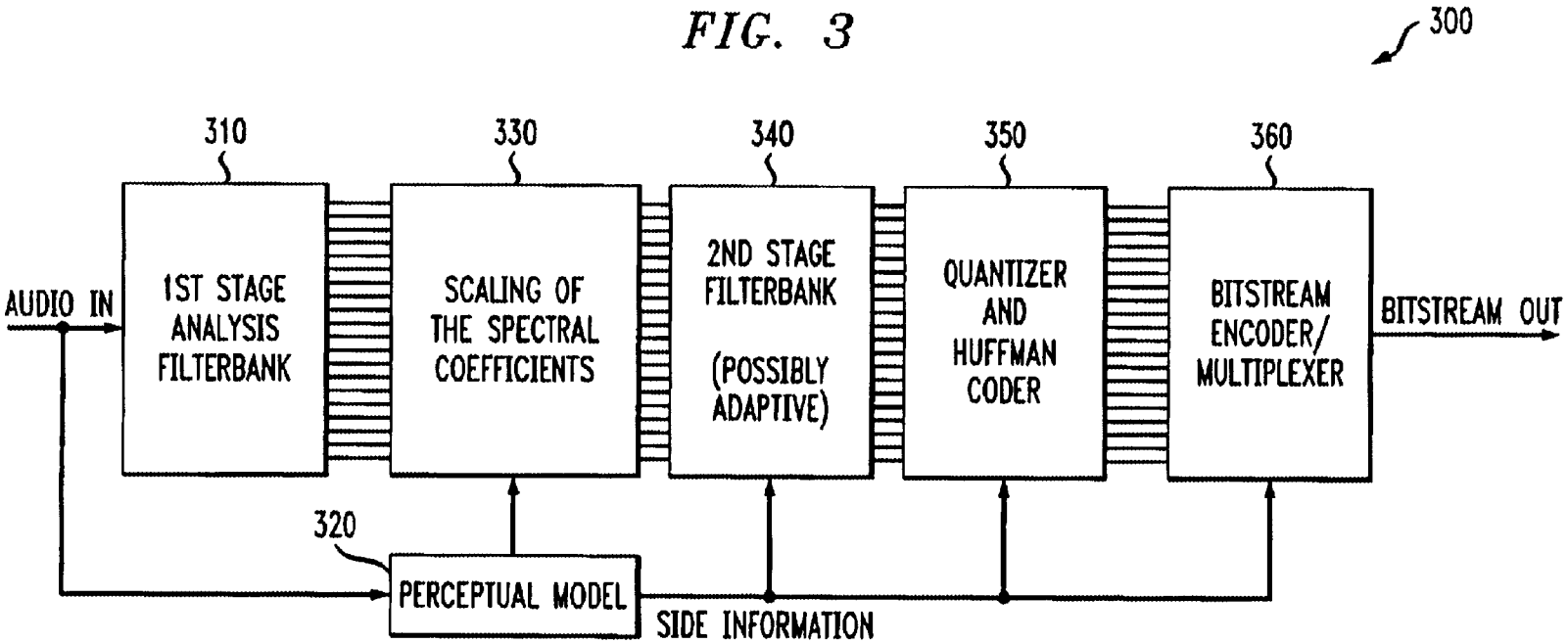
FIG. 3 is a schematic block diagram of a perceptual audio coder according to the present invention.
Figure 4:
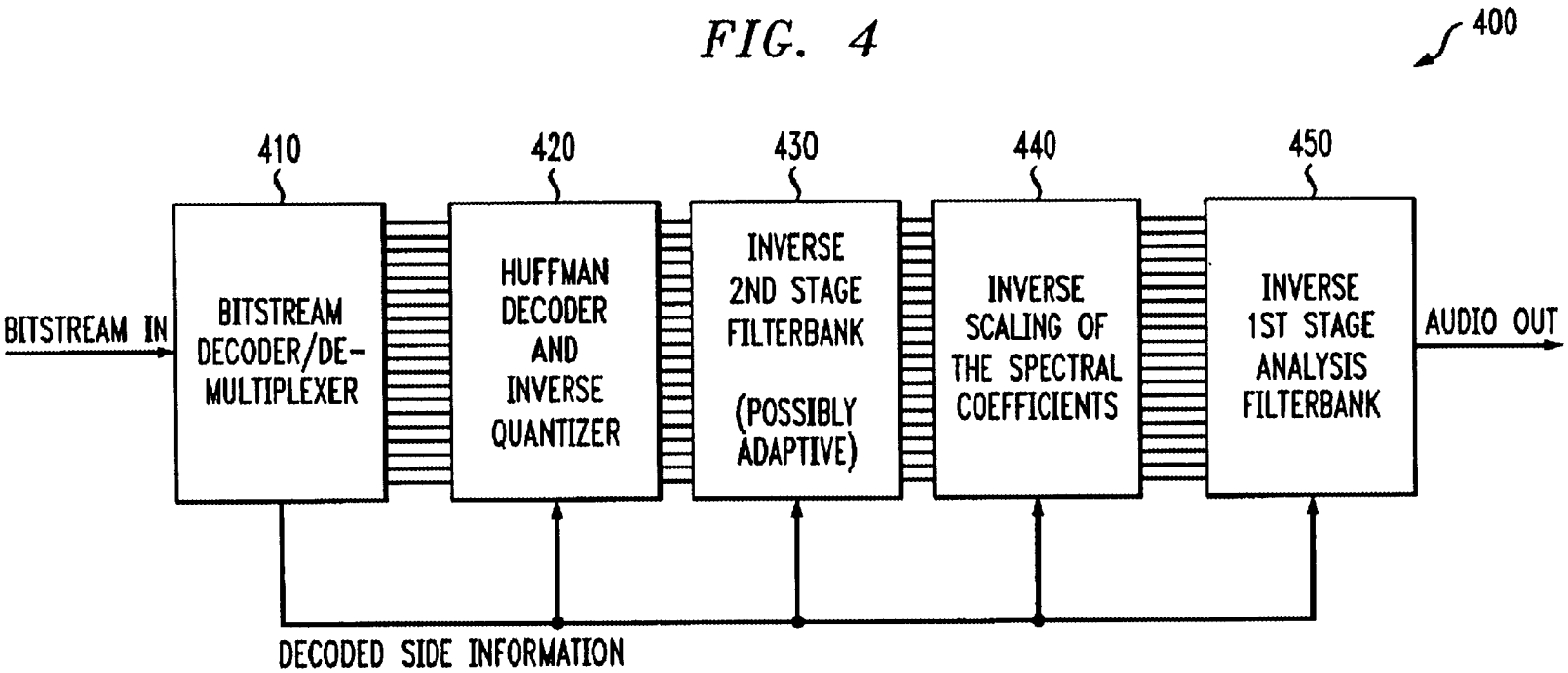
FIG. 4 is a schematic block diagram of the perceptual audio decoder corresponding to the perceptual audio coder of FIG. 3 and incorporating features of the present invention.

FIG. 3 is a schematic block diagram of a perceptual audio coder 300 according to the present invention for communicating an audio signal, such as speech or music. The corresponding perceptual audio decoder 400 is shown in FIG. 4. While the present invention is illustrated using audio signals, it is noted that the present invention can be applied to the coding of other signals, such as the temporal, spectral, and spatial sensitivity of the human visual system, as would be apparent to a person of ordinary skill in the art, based on the disclosure herein.

The present invention permits independent selection of spectral and temporal resolutions for the redundancy reduction and irrelevancy reduction using cascaded filterbanks. A first analysis filterbank 310 is dedicated to the irrelevancy reduction function and a second analysis filterbank 340 is dedicated to the redundancy reduction function. Thus, according to one feature of the present invention, a first filterbank 310 with a spectral/temporal resolution suitable for irrelevancy reduction is cascaded with a second stage filterbank 340 having a spectral/temporal resolution suitable for maximum redundancy reduction. The spectral/temporal resolution of the first filterbank 310 is based on the employed perceptual model. Likewise, the spectral/temporal resolution of the second stage filterbank 340 has increased spectral resolution for improved redundancy reduction. By using a cascadaded filterbank in this manner, and scaling the coefficients between the cascades, a different spectral/temporal resolution can be used for the irrelevancy reduction and the redundancy reduction.

Cascaded Filterbanks

As shown in FIG. 3, the perceptual audio coder 300 includes the first analysis filterbank 310, a perceptual model 320, a scaling block 330 that scales the spectral coefficients, the second analysis filterbank 340, a quantization and coding block 350 and a bitstream encoder/multiplexer 360. The first analysis filterbank 310 converts the input samples into a sub-sampled spectral representation to perform irrelevancy reduction. The perceptual model 320 estimates the masked threshold of the signal. For each spectral coefficient, the masked threshold gives the maximum coding error that can be introduced into the audio signal while still maintaining perceptually transparent signal quality. The scaling block 330 scales the coefficients between the cascades first analysis filterbank 310 and second analysis filterbank 340, based on the employed perceptual model 320.

The second analysis filterbank 340 performs redundancy reduction. The quantization and coding block 350, discussed further below, quantizes and codes the spectral values according to the precision corresponding to the masked threshold estimate received from the perceptual model 320. Thus, the quantization noise is hidden by the respective transmitted signal. Finally, the coded spectral values and additional side information are packed into a bitstream and transmitted to the decoder by the bitstream encoder/multiplexer 360.

As shown in FIG. 3, the second analysis filterbank 340 is optionally adaptive to the statistics of the signal at the input to the filterbank 340 to determine the best spectral and temporal resolution for performing the redundancy reduction.

Quantization and Encoding

The quantizer 350 quantizes the spectral values according to the precision corresponding to the masked threshold estimate in the perceptual model 320. Typically, this is implemented by scaling the spectral values before a fixed quantizer is applied. In perceptual audio coders, the spectral coefficients are grouped into coding bands. Within each coding band, the samples are scaled with the same factor. Thus, the quantization noise of the decoded signal is constant within each coding band and is typically represented using a step-like function. In order not to exceed the masked threshold for transparent coding, a perceptual audio coder chooses for each coding band a scale factor that results in a quantization noise corresponding to the minimum of the masked threshold within the coding band.

The step-like function of the introduced quantization noise can be viewed as the approximation of the masked threshold that is used by the perceptual audio coder. The degree to which this approximation of the masked threshold is lower than the real masked threshold is the degree to which the signal is coded with a higher accuracy than necessary. Thus, the irrelevancy reduction is not fully exploited. In a long transform window mode, perceptual audio coders use almost four times as many scale-factors than in a short transform window mode. Thus, the loss of irrelevancy reduction exploitation is more severe in PAC's short transform window mode. On one hand, the masked threshold should be modeled as precisely as possible to fully exploit irrelevancy reduction; but on the other hand, only as few bits as possible should be used to minimize the amount of bits spent on side information.

Audio coders, such as perceptual audio coders, shape the quantization noise according to the masked threshold. The masked threshold is estimated by the psychoacoustical model 120. For each transformed block n of N samples with spectral coefficients $\{c_k(n)\}$ $(0<k<N)$, the masked threshold is given as a discrete power spectrum $\{M_k(n)\}$ $(0<k<N)$. For each spectral coefficient of the filterbank $c_k(n)$, there is a corresponding power spectral value $M_k(n)$. The value $M_k(n)$ indicates the variance of the noise that can be introduced by quantizing the corresponding spectral coefficient $c_k(n)$ without impairing the perceived signal quality.

As previously indicated, the coefficients are scaled before applying a fixed linear quantizer with a step size of Q in the encoder. Each spectral coefficient $c_k(n)$ is scaled given its corresponding masked threshold value, $M_k(n)$, as follows:

$$\tilde{c}_k(n) = \frac{Q}{\sqrt{12M_k(n)}} c_k(n), \tag{1}$$

The scaled coefficients are thereafter quantized and mapped to integers $i_k(n)=\text{Quantizer}(\tilde{c}_k(n))$. The quantizer indices $i_k(n)$ are subsequently encoded using a noiseless coder 350, such as a Huffinan coder. In the decoder, after applying the inverse Huffman coding, the quantized integer coefficients $i_k(n)$ are inverse quantized $q_k(n)=\text{Quantizer}^{-1}(i_k(n))$. The process of quantizing and inverse quantizing adds white noise $d_k(n)$ with a variance of $\sigma_d=Q^2/12$ to the scaled spectral coefficients $\tilde{c}_k(n)$, as follows:

$$q_k(n)=\tilde{c}(n)+d_k(n), \tag{2}$$

In the decoder, the quantized scaled coefficients $q_k(n)$ are inverse scaled, as follows:

$$\hat{c}_k(n) = \frac{\sqrt{12M_k(n)}}{Q} q_k(n) = c_k(n) + \frac{\sqrt{12M_k}\,(n)}{Q} d_k(n), \tag{3}$$

The variance of the noise in the spectral coefficients of the decoder ($\sqrt{12M_k/Q}d_k$ (n) in Eq. 3) is $M_k(n)$. Thus, the power spectrum of the noise in the decoded audio signal corresponds to the masked threshold.

As shown in FIG. 4, the perceptual audio decoder 400 includes a bitstream decoder/demultiplexer 410, a decoder and inverse quantizer 420, an inverse second analysis filterbank 430, a scaling block 400 for scaling the spectral coefficients and an inverse first analysis filterbank 450. Each of these block perform the inverse function of the corresponding block in the perceptual audio coder 300, as discussed above.

It is to be understood that the embodiments and variations shown and described herein are merely illustrative of the principles of this invention and that various modifications may be implemented by those skilled in the art without departing from the scope and spirit of the invention.

We claim:

1. A method for encoding a signal, comprising the steps of:

filtering said signal using a first filterbank controlled by a psychoacoustic model, said first filterbank having a first spectral/temporal resolution for irrelevancy reduction;

filtering said signal using a second stage filterbank having a second spectral/temporal resolution for redundancy reduction, wherein said second spectral/temporal resolution is selected independent of said first spectral/temporal resolution; and quantizing and encoding spectral values produced by said second filterbank.

2. The method of claim 1, further comprising the step of scaling said spectral coefficients between said first filterbank and said second stage filterbank.

3. The method of claim 2, wherein said scaling is based on said psychoacoustic model.

4. The method of claim 1, wherein said quantizing and encoding step reduces the mean square error in said signal.

5. The method of claim 1, wherein said first spectral/temporal resolution is a frequency dependent temporal and spectral resolution suitable for irrelevancy reduction.

6. The method of claim 1, wherein said signal is an audio signal.

7. The method of claim 1, wherein said signal is an image signal.

8. The method of claim 1, further comprising the step of transmitting said encoded signal to a decoder.

9. The method of claim 1, further comprising the step of recording said encoded signal on a storage medium.

10. The method of claim 1, wherein said encoding further comprises the step of employing an adaptive Huffinan coding technique.

11. The method of claim 1, wherein said encoding further comprises the step of employing a transform coding technique.

12. A method for encoding a signal, comprising the steps of:

reducing irrelevant information in said signal using a first filterbank having a first spectral/temporal resolution;

reducing redundant information in said signal using a second stage filterbank having a second spectral/temporal resolution, wherein said second spectral/temporal resolution is selected independent of said first spectral/temporal resolution; and quantizing and encoding spectral values produced by said second filterbank.

13. The method of claim 12, further comprising the step of scaling said spectral coefficients between said first filterbank and said second stage filterbank.

14. The method of claim 13, wherein said scaling is based on said perceptual model.

15. The method of claim 12, wherein said first spectral/temporal resolution is a frequency dependent temporal and spectral resolution for irrelevancy reduction.

16. A method for decoding a signal, comprising the steps of:

decoding and dequantizing said signal;

decoding side information for scaling control information transmitted with said signal; and filtering said signal using a second stage filterbank having a first spectral/temporal resolution for redundancy reduction; and filtering the dequantized signal with a first filterbank controlled by said decoded side information having a second spectral/temporal resolution for irrelevancy reduction, wherein said second spectral/temporal resolution is selected independent of said first spectral/temporal resolution.

17. The method of claim 16, wherein said decoding and dequantizing step uses an inverse transform or synthesis filter bank for redundancy reduction.

18. The method of claim 16, further comprising the steps of decoding and dequantizing spectral components obtained from a transform or synthesis filter bank, and wherein said decoding and dequantizing steps employ fixed quantizer step sizes.

19. The method of claim 16, wherein the filter order and the intervals of filter adaptation of said first filterbank are selected for irrelevancy reduction.

20. A system for encoding a signal, comprising:

means for filtering said signal using a first filterbank controlled by a psychoacoustic model, said first filterbank having a first spectral/temporal resolution for irrelevancy reduction;

means for filtering said signal using a second stage filterbank having a second spectral/temporal resolution for redundancy reduction, wherein said second spectral/temporal resolution is selected independent of said first spectral/temporal resolution; and means for quantizing and encoding spectral values produced by said second filterbank.

21. A system for encoding a signal, comprising:

a first filterbank controlled by a psychoacoustic model, said first filterbank having a first spectral/temporal resolution for irrelevancy reduction;

a second stage filterbank having a second spectral/temporal resolution for redundancy reduction, wherein said second spectral/temporal resolution is selected independent of said first spectral/temporal resolution; and a quantizer/encoder for quantizing and encoding spectral values produced by said second filterbank.

22. A system for decoding a signal, comprising:

means for decoding and dequantizing said signal;

means for decoding side information for scaling control information transmitted with said signal; and means for filtering said signal using a second stage filterbank having a first spectral/temporal resolution for redundancy reduction; and means for filtering the dequantized signal with a first filterbank controlled by said decoded side information having a second spectral/temporal resolution for irrelevancy reduction, wherein said second spectral/temporal resolution is selected independent of said first spectral/temporal resolution.

23. A system for decoding a signal, comprising:

a decoder/dequantizer for decoding and dequantizing said signal and side information for scaling control information transmitted with said signal; and a second stage filterbank having a first spectral/temporal resolution for redundancy reduction; and a first filterbank controlled by said decoded side information having a second spectral/temporal resolution for irrelevancy reduction, wherein said second spectral/temporal resolution is selected independent of said first spectral/temporal resolution.

* * * * *

UNITED STATES PATENT AND TRADEMARK OFFICE

CERTIFICATE OF CORRECTION

PATENT NO. : 6,678,647 B1
DATED : January 13, 2004
INVENTOR(S) : Edler et al.

It is certified that error appears in the above-identified patent and that said Letters Patent is hereby corrected as shown below:

Column 5,
Line 19, after "$\{c_k(n)\}$", replace "$(0<k<N)$" with -- $(0\leq k<N)$ --.
Line 20, after "$\{M_k(n)\}$", replace "$(0<k<N)$" with $(0\leq k<N)$ --.

Column 6,
Lines 16 and 51, before "filterbank" and after "second" insert -- stage --.
Line 36, after "adaptive" replace "Huffinan" with -- Huffman --.
Line 64, after "signal" delete "and".

Column 7,
Line 9, before "for" replace "filter bank" with -- filterbank --.
Line 12, before "and" and after "synthesis" replace "filter bank" with -- filterbank --.
Line 30, before "filterbank" and after "second" insert -- stage --.

Column 8,
Line 7, before "filterbank" and after "second" insert -- stage --.
Lines 11 and 25, after "signal" delete "and".

Signed and Sealed this

Twenty-seventh Day of September, 2005

JON W. DUDAS
*Director of the United States Patent and Trademark Office*